US007087093B2

(12) United States Patent
Tanioka et al.

(10) Patent No.: US 7,087,093 B2
(45) Date of Patent: Aug. 8, 2006

(54) MODIFICATION OF FIBERS OR FABRICS

(75) Inventors: Soji Tanioka, Chiyoda-ku (JP); Sakae Obara, Chiyoda-ku (JP)

(73) Assignee: Shin-Etsu Chemicals Co., Ltd., Tokyo (JP)

( * ) Notice: Subject to any disclaimer, the term of this patent is extended or adjusted under 35 U.S.C. 154(b) by 148 days.

(21) Appl. No.: 10/752,720

(22) Filed: Jan. 8, 2004

(65) Prior Publication Data

US 2004/0133990 A1 Jul. 15, 2004

(30) Foreign Application Priority Data

Jan. 10, 2003 (JP) ..... 2003-003940

(51) Int. Cl.
*D06M 11/38* (2006.01)

(52) U.S. Cl. ..... 8/115.69; 427/337

(58) Field of Classification Search ..... 8/115.69; 427/337

See application file for complete search history.

(56) References Cited

FOREIGN PATENT DOCUMENTS

| | | | |
|---|---|---|---|
| GB | 480774 | A | 2/1938 |
| GB | 600355 | A | 4/1948 |
| GB | 1041020 | A | 9/1966 |
| JP | 60-137938 | A | 7/1985 |
| JP | 61-252369 | A | 11/1986 |

*Primary Examiner*—Margaret Einsmann
(74) *Attorney, Agent, or Firm*—Birch, Stewart, Kolasch & Birch, LLP

(57) ABSTRACT

Fibers are modified by applying a solution of a low substituted cellulose ether having a molar degree of substitution with alkyl and/or hydroxyalkyl groups in the range of 0.05 to 1.0 in an aqueous alkali solution to fibers, and causing the solution borne on fibers to coagulate. The method achieves satisfactory fiber modifications with respect to antistatic property, moisture absorption and shrink resistance without a cumbersome step of dissolution while ensuring safety.

7 Claims, No Drawings

MODIFICATION OF FIBERS OR FABRICS

This Non-provisional application claims priority under 35 U.S.C. 517 119(a) on patent application No(s). 2003-003940 filed in Japan on Jan. 10, 2003, the entire contents of which are hereby incorporated by reference.

BACKGROUND OF THE INVENTION

1. Field of the Invention

This invention relates to a method for modifying fibers or fabrics.

2. Background Art

For synthetic and natural fibers, it is desired from the past to impart antistatic and moisture absorption properties to synthetic fibers and to improve the texture and shrink resistance of natural fibers. It has been proposed to achieve such improvements by applying viscose to fibers, coagulating and regenerating the viscose, water washing and drying, thereby coating surfaces of fibers with regenerated cellulose.

However, several problems are left with the modifying method of coating fibers with regenerated cellulose derived from viscose because the method includes the steps of applying viscose (i.e., a solution in an aqueous sodium hydroxide solution of cellulose xanthate formed by modifying cellulose with highly toxic carbon disulfide) to fibers and then coagulating and regenerating the viscose. In the steps of forming, coagulating and regenerating cellulose xanthate, workers can be exposed to carbon disulfide. This fiber modifying method is also insufficient in improving antistatic, moisture absorption and shrink resistant properties because the regenerated cellulose coated itself has insufficient moisture absorption.

To solve the problems associated with the method of modifying fibers by coating them with regenerated cellulose derived from viscose, JP-A 61-252369 discloses to modify fibers by applying an aqueous sodium hydroxide solution of cellulose to fibers, coagulating and regenerating for thereby coating surfaces of fibers with regenerated cellulose. This method, however, is limited in that cellulose must be dissolved in an aqueous sodium hydroxide solution at low temperature. Additionally, the cellulose used as the raw material must be one whose solubility is increased by reducing a crystalline structure, for example, a cellulose obtained by acid hydrolysis of wood pulp followed by ball milling, or a regenerated cellulose prepared from viscose or the like.

SUMMARY OF THE INVENTION

An object of the invention is to provide a fiber modifying method which eliminates the toxic problem of carbon disulfide, ensures ease of dissolution, and achieves significant effects of modifying moisture absorption, antistatic and shrink resistant properties as compared with the conventional method of coating fibers with regenerated cellulose.

It has been found that when a solution of a low substituted cellulose ether substituted with alkyl and/or hydroxyalkyl groups to a molar degree of substitution in the range of 0.05 to 1.0 in an aqueous alkali solution is applied to fibers and then coagulated thereon, the fibers are effectively modified so as to exhibit improved moisture absorption, antistatic and shrink resistant properties without the problem of carbon disulfide.

Accordingly the present invention provides a method for modifying fibers, comprising the steps of applying a solution of a low substituted cellulose ether having a molar degree of substitution with alkyl and/or hydroxyalkyl groups in the range of 0.05 to 1.0 in an aqueous alkali solution to fibers, and then causing the solution applied to fibers to coagulate.

DESCRIPTION OF THE PREFERRED EMBODIMENTS

The fibers used herein are not particularly limited. Examples include synthetic fibers such as polyethylene fibers, polypropylene fibers, polyester fibers, nylon fibers, acrylic fibers, vinylon fibers, rayon fibers, vinyl chloride fibers and vinylidene chloride fibers, and natural fibers such as silk, wool, cellulose and hemp. By the term "fibers" used herein are encompassed filamentous fibers, fabrics made by weaving filamentous fibers, and non-woven fabrics.

The "low substituted cellulose ether" used herein means that the hydrogen atoms of hydroxyl groups on glucose rings constituting cellulose are substituted with alkyl and/or hydroxyalkyl groups to a molar degree of substitution of 0.05 to 1.0, preferably 0.1 to 0.7. The low substituted cellulose ether is insoluble in water, but soluble in aqueous alkaline solution. If the molar degree of substitution is less than 0.05, the cellulose ether becomes less soluble in aqueous alkaline solution. If the molar degree of substitution is more than 1.0, the cellulose ether loses resistance (fastness) to water and will leave fibers during laundering (i.e., increased drop-out).

Examples of the low substituted cellulose ether include low substituted alkyl celluloses such as low substituted methyl cellulose and low substituted ethyl cellulose; low substituted hydroxyalkyl celluloses such as low substituted hydroxyethyl cellulose and low substituted hydroxypropyl cellulose; and low substituted hydroxyalkyl alkyl celluloses such as low substituted hydroxypropyl methyl cellulose, low substituted hydroxyethyl methyl cellulose, and low substituted hydroxyethyl ethyl cellulose.

According to the invention, fibers are modified by dissolving a low substituted cellulose ether as described above in an aqueous alkaline solution, applying the solution to fibers as by coating or dipping (for impregnation), so that the solution attaches to fibers, optionally removing the extra solution by means of a centrifuge, mangle or knife coater, and coagulating the solution borne on fibers.

Suitable aqueous alkaline solutions used herein include aqueous solutions of sodium hydroxide and potassium hydroxide. The caustic alkali concentration may be determined as appropriate since it varies with the type and degree of substitution of substituent groups on the low substituted cellulose ether. Usually, the caustic alkali concentration is 2 to 25% by weight, preferably 3 to 15% by weight. With an alkali concentration of less than 2 wt %, the low substituted cellulose ether may not be dissolved. With an alkali concentration of more than 25 wt %, the low substituted cellulose ether solution may become gel-like, interfering with the subsequent steps of application and impregnation. In a typical example, a low substituted hydroxypropyl cellulose having a molar degree of substitution of 0.2 is dissolved in an aqueous sodium hydroxide solution having a concentration of 10 wt %.

On the other hand, the concentration of low substituted cellulose ether in the aqueous alkaline solution is preferably 0.5 to 15% by weight, more preferably 1 to 10% by weight.

Application of the solution may be performed by means of a suitable applicator such as a blade coater, transfer coater or air doctor coater. Alternatively, an impregnator of prewetting, float or doctor bar type may be used to immerse fibers in the solution for impregnation.

The solution borne on fibers is coagulated by any desired technique, for example, a salting-out coagulation technique of contacting the solution with an aqueous salt solution for coagulation, or a neutralization coagulation technique of contacting the solution with an aqueous acid solution for coagulation.

In the event of salting-out coagulation, use may be made of aqueous solutions of salts such as ammonium chloride, ammonium sulfate, sodium sulfate, sodium chloride, zinc sulfate, magnesium sulfate, sodium phosphate, ammonium phosphate, sodium thiosulfate, sodium carbonate, sodium bicarbonate, sodium fatty acid salts, and sodium benzenesulfonate. Although the concentration of the aqueous salt solution is not critical, a concentration of at least 5% by weight, especially 7 to 40% by weight is preferred. Coagulation can be induced simply by immersing the fibers having the cellulose ether solution borne thereon in the aqueous salt solution.

In the event of neutralization coagulation, the fibers having the cellulose ether solution borne thereon are immersed in an aqueous solution of a mineral acid such as hydrochloric acid or sulfuric acid or an organic acid such as citric acid, malic acid or acetic acid. The acid concentration of this aqueous solution is preferably 1 to 20% by weight, especially 2 to 15% by weight.

When the solution borne on fibers is coagulated, any of these coagulation techniques may be used alone. It is also possible to combine the salting-out coagulation technique with the neutralization coagulation technique. Suitable combinations of coagulation techniques include salting-out coagulation of the fiber-borne solution followed by neutralization coagulation, and coagulation in an aqueous solution containing both a salt and an acid.

After the coagulation treatment, the fibers may be washed with water to remove the salts as impurities and then dried. Drying may be done in any desired manner.

The fiber modifying method of the invention achieves significant effects of modifying moisture absorption, antistatic and shrink resistant properties as compared with the conventional method of coating fibers with regenerated cellulose derived from viscose or cellulose. Another advantage of eliminating a need for a toxic substance that can be hazardous to the health of workers is of significance in the industry. A further advantage is to eliminate a cumbersome operation when a low substituted cellulose ether is dissolved in an aqueous alkali solution. A cellulose ether solution may be prepared simply by adding a low substituted cellulose ether to an aqueous alkali solution and agitating the solution.

It is noted that the amount of low substituted cellulose ether solution borne on fibers may be determined as appropriate. The percent pickup, that is, [(weight of low substituted cellulose ether solution borne)/(weight of base fibers)]×100 is preferably 30 to 500% by weight, especially 50 to 300% by weight. If the percent pickup is less than 30 wt %, the coverage of low substituted cellulose ether on fibers may be too low to exert satisfactory modifying effects on fibers. If the percent pickup is more than 500 wt %, the texture of fibers may be rather exacerbated, and the effects of modifying antistatic and moisture absorption properties may not be so compliant with the addition amount.

EXAMPLE

Examples of the invention are given below by way of illustration and not by way of limitation.

Examples 1–6

A treating solution was prepared by dissolving 3 parts by weight of a low substituted cellulose ether as shown in Table 1 in 97 parts by weight of a 10 wt % aqueous solution of sodium hydroxide. Then 5 parts by weight of polyester fabric was immersed in the treating solution and squeezed through a roller mangle to a percent pickup of 108 wt %. Thereafter, the fabric was immersed in an aqueous solution containing 10 wt % sodium sulfate and 10 wt % sulfuric acid for causing the low substituted cellulose ether to coagulate. The fabric was thoroughly washed with water and dried, obtaining a modified sample.

TABLE 1

| | | Molar degree of substitution | |
|---|---|---|---|
| Designation | Material | Methyl | Hydroxypropyl |
| A | low substituted | | 0.18 |
| B | hydroxypropyl cellulose | | 0.26 |
| C | | | 0.35 |
| D | | | 0.50 |
| E | low substituted hydroxypropyl methyl cellulose | 0.14 | 0.14 |
| F | low substituted methyl cellulose | 0.21 | |

The samples obtained in this way were examined for antistatic property and water absorption rate by the following tests. The results are shown in Table 2.

[Antistatic Property]

The half-life of triboelectric potential was measured according to JIS L1094 (1980).

[Water Absorption Rate]

Measured according to JIS L1096 (1979), method 6.26.1B.

Comparative Example 1

Samples were prepared as in Examples 1–6 except that the treating solution was 100 parts by weight of a viscose having a cellulose equivalent concentration of 3 wt % and a sodium hydroxide concentration of 6 wt %. The samples were similarly examined for antistatic property and water absorption rate, with the results shown in Table 2.

Comparative Example 2

As a control, the polyester fabric used in Examples 1–6 and Comparative Example 1 was similarly examined for antistatic property and water absorption rate, with the results shown in Table 2.

TABLE 2

| Example | Low substituted cellulose ether | Half-life (sec) | Water absorption rate (cm/10 min) |
|---|---|---|---|
| 1 | A | 9 | 14.3 |
| 2 | B | 8 | 14.9 |
| 3 | C | 6 | 15.3 |
| 4 | D | 6 | 15.7 |
| 5 | E | 7 | 14.8 |
| 6 | F | 8 | 14.6 |
| Comparative Example 1 | | 13 | 12.4 |
| Comparative Example 2 | | >60 | 0 |

Examples 7–12

Samples were prepared as in Examples 1–6 except that cotton fabric was immersed in the treating solution prepared in Examples 1–6 and squeezed to a percent pickup of 53 wt %. The percent shrinkage of each sample was measured according to JIS L1042 (1983), with the results shown in Table 3.

Comparative Example 3

A sample was prepared as in Examples 7–12 except that the treating solution prepared in Comparative Example 1 was used. The percent shrinkage of the sample was measured, with the results shown in Table 3.

Comparative Example 4

As a control, the percent shrinkage of the cotton fabric used in Examples 7–12 and Comparative Example 3 was measured, with the results shown in Table 3.

TABLE 3

| Example | Low substituted cellulose ether | Shrinkage (%) |
|---|---|---|
| 7 | A | 2.1 |
| 8 | B | 1.8 |
| 9 | C | 1.6 |
| 10 | D | 1.6 |
| 11 | E | 1.8 |
| 12 | F | 2.0 |
| | Comparative Example 3 | 3.3 |
| | Comparative Example 4 | 5.7 |

The method for modifying fibers according to the invention achieves satisfactory fiber modifications with respect to antistatic property, moisture absorption and shrink resistance without a cumbersome step of dissolution while ensuring safety.

Japanese Patent Application No. 2003-003940 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for modifying fibers, comprising the steps of:

applying a solution of a low substituted cellulose ether having a molar degree of substitution with alkyl and/or hydroxyalkyl groups in the range of 0.18 to 0.7 in an aqueous sodium hydroxide solution to fibers, and causing the solution borne on fibers to coagulate, wherein said low substituted cellulose ether is at least one selected from the group consisting of low substituted methyl cellulose, low substituted ethyl cellulose, low substituted hydroxypropyl cellulose, low substituted hydroxypropyl methyl cellulose, low substituted hydroxyethyl methyl cellulose and low substituted hydroxyethyl ethyl cellulose, and the aqueous sodium hydroxide solution consists of water and sodium hydroxide.

2. The method of claim 1 wherein the aqueous sodium hydroxide solution has an alkali concentration of 2 to 25% by weight.

3. The method of claim 2 wherein the concentration of low substituted cellulose ether in the aqueous sodium hydroxide solution is 0.5 to 15% by weight.

4. The method of claim 1 wherein the step of causing the solution borne on fibers to coagulate includes salting-out coagulation, neutralization coagulation or a combination thereof.

5. The method of claim 4 wherein an aqueous solution of salts of ammonium chloride, ammonium sulfate, sodium sulfate, sodium chloride, zinc sulfate, magnesium sulfate, sodium phosphate, ammonium phosphate, sodium thiosulfate, sodium carbonate, sodium bicarbonate, sodium fatty acid salts or sodium benzenesulfonate is used for the salting-out coagulation.

6. The method of claim 1 wherein the fibers are synthetic fibers.

7. The method of claim 1 wherein the amount of low substituted cellulose ether solution borne on fibers (percent pickup) is 30 to 500% by weight, and wherein the percent pickup is defined by the following formula:

percent pickup=((weight of low substituted cellulose ether solution borne)/(weight of base fibers))×100.

* * * * *